US006709516B1

(12) United States Patent
Vähäkuopus et al.

(10) Patent No.: US 6,709,516 B1
(45) Date of Patent: Mar. 23, 2004

(54) APPARATUS FOR PREVENTING THE DIRECTION OF A HARMFUL JET FROM A SPRAYING NOZZLE ON A WEB

(75) Inventors: Mika Vähäkuopus, Helsinki (FI); Vilho Nissinen, Numminen (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/868,696

(22) PCT Filed: Dec. 21, 1999

(86) PCT No.: PCT/FI99/01067

§ 371 (c)(1),
(2), (4) Date: Jul. 9, 2001

(87) PCT Pub. No.: WO00/37739

PCT Pub. Date: Jun. 29, 2000

(30) Foreign Application Priority Data

Dec. 21, 1998 (FI) ..... 982765

(51) Int. Cl.[7] ..... B05B 15/04; B05B 1/28
(52) U.S. Cl. ..... 118/301; 118/504; 101/147
(58) Field of Search ..... 118/301, 406, 118/504, 213; 239/112, 122; 101/147, 127

(56) References Cited

U.S. PATENT DOCUMENTS

| | | | | | |
|---|---|---|---|---|---|
| 4,331,299 | A | * | 5/1982 | Culbertson et al. | 239/691 |
| 4,781,941 | A | * | 11/1988 | Inukai et al. | 427/466 |
| 4,993,242 | A | | 2/1991 | Poor | 68/13 |
| 5,388,510 | A | * | 2/1995 | Hansson | 101/147 |
| 6,050,186 | A | * | 4/2000 | Tomikura et al. | 101/147 |

FOREIGN PATENT DOCUMENTS

WO WO 97/13035 4/1997

* cited by examiner

*Primary Examiner*—Richard Crispino
*Assistant Examiner*—Yewebdar T Tadesse
(74) *Attorney, Agent, or Firm*—Cohen, Pontani, Lieberman & Pavane

(57) ABSTRACT

The present invention relates to an assembly and a method for preventing the spray emitted by a spraying nozzle (1) from reaching the surface of a paper web, said nozzle (1) being disposed at a distance from the surface of the paper web to be coated and further being directed toward said web surface to be coated. To in front of the spray emitted by the nozzle (1), between the spray and the paper web, there is adapted a movable baffle (2, 6) serving to prevent the spray from reaching the surface of the paper web.

14 Claims, 1 Drawing Sheet

APPARATUS FOR PREVENTING THE DIRECTION OF A HARMFUL JET FROM A SPRAYING NOZZLE ON A WEB

PRIORITY CLAIM

This is a national stage of PCT application No. PCT/F199/01067, filed on Dec. 21, 1999. Priority is claimed on that application, and on patent application No. 982765 filed in Finland on Dec. 21, 1998.

FIELD OF THE INVENTION

The present invention relates to a method and apparatus for preventing the detrimental spray emitted by a spraying nozzle from reaching the surface of a paper web.

Coating a paper sheet with a pigment slurry is performed by applying a coat of uniform quantity and quality to the surface of a paper web, after which excess water is removed from the web by means of dryers. The coating process steps can be divided into the application step, which comprises spreading of the coating mix onto the surface of the moving web, the control of the final coat weight and the smoothing of the coat surface.

A technique suitable for use in coating a paper web is the so-called spray-coating method that is described, e.g., in the international patent application publication WO 97/13035. In the spray-coating technique, the coating mix is administered to the paper sheet surface by application from spraying nozzles in which the coating mix is atomized into small droplets prior to spraying onto the moving paper web. The atomization of the coating mix in the spraying nozzle may be based on, e.g., a rotary motion, high-pressure atomization of a liquid coating or high-pressure air-assist/blast nozzles. The coat quality can be controlled by adjusting the distance between the spraying nozzle and the web, the spray-jet velocity and the mass rate of spraying. Generally, there must be disposed a number of spraying nozzles in the cross-machine direction to the web travel, because the coverage of the spraying jet emitted by a single nozzle is usually narrower than the web width. Typically, there is disposed a number of staggered nozzle rows across the web, perpendicular to the web travel, since a single row of nozzles extending across the web usually fails to provide a coating of a sufficiently high quality. In order to collect the coating mist occurring in the coating process and to recover the same from the air, the spraying nozzles are located in a closed space sealed from the environment, such as an enclosing hood having an exit opening made thereto for coating mist removal.

The maintenance of spraying nozzles and coating mix feed lines includes washing. Conventionally, the washing operation is carried out by injecting washing liquid into the feed line and spraying nozzles to be washed. Preferably, the washing operation should be arranged to be feasible also in a running papermaking machine in a manner not causing disturbance to the coating process of the paper web. Currently, this is possible if only a small quantity of the nozzles is washed at a time, whereby the deterioration of the coat quality remains essentially negligible. Moreover, the washing liquid emitted from the spraying nozzles must be prevented from reaching the surface of the paper web being coated.

SUMMARY OF THE INVENTION

It is an object of the present invention to provide a novel type of assembly and method for preventing a washing liquid spray or other detrimental spray from being directed toward the paper web.

The goal of the invention is attained by inserting during the washing operation to in front of the spray emitted by the nozzle a baffle that prevents the washing liquid passed via the nozzles from reaching the paper web.

More specifically, the assembly according to the invention is characterized by what is stated in the characterizing part of claim 1.

Furthermore, the method according to the invention is characterized by what is stated in the characterizing part of claim 9.

The invention offers significant benefits.

By virtue of the invention, the spraying nozzles employed in the coating process of a paper web can be washed also in a running papermaking machine without causing disturbance to the coating process. Moreover, the embodiment according to the invention is uncomplicated and cost-advantageous to implement as well as easy to automate.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the drawings, wherein like reference numerals delineate similar elements throughout the several views.

DETAILED DESCRIPTION OF THE PRESENTLY PREFERRED EMBODIMENTS

Figure 1A:
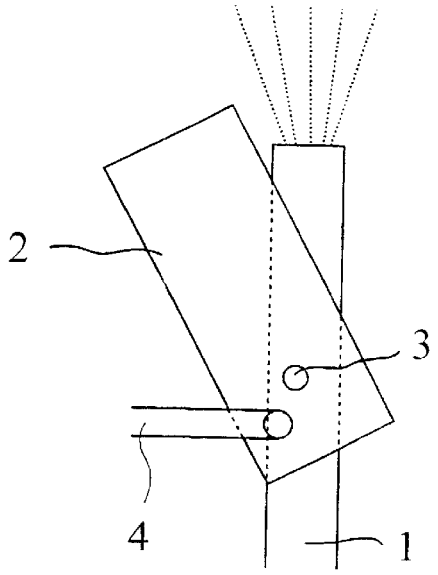
FIG. 1 shows a side view of an embodiment of an assembly according to the invention in its different operating positions A and B.
Figure 1B:
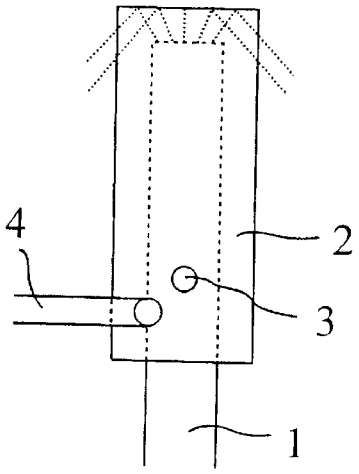

In detail A of FIG. 1, a spraying nozzle 1 is shown in its normal operating position, wherein it sprays coating mix onto a paper web running above the nozzle 1. Herein, a baffle 2 is rotated away from in front of the spray emitted by the nozzle 1 and the coating mix can reach the surface of the paper web unobstructedly. In detail B of FIG. 1, the nozzle 1 is shown in its washing position, wherein the baffle 2 is rotated by an actuator means 4 such as a cylinder or a motor about a pivot point 3 to in front of the washing liquid spray emitted from the spraying nozzle 1. Herein, the baffle 2 prevents the washing liquid spray emitted by the nozzle 1 from reaching the paper web.

Figure 2A:
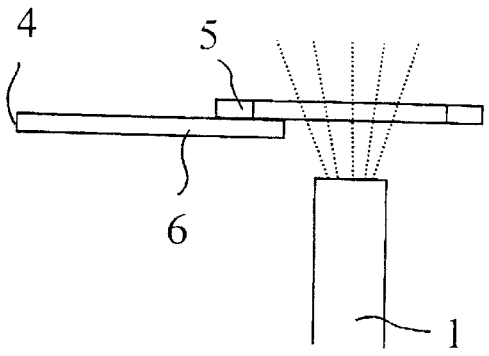
FIGS. 2A–2B shows a side view of another embodiment of an assembly according to the invention in its different operating positions A and B.
Figure 2B:
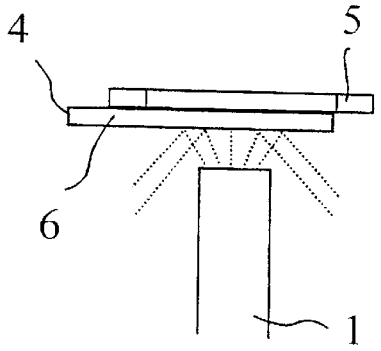

The embodiment shown in FIG. 2 comprises a stationary baffle 5 and a movable baffle 6 adapted to be moved by means of an actuator 4. The stationary baffle 5 has an opening that coincides with the spray emitted by the spraying nozzle 1 and, correspondingly, the movable baffle 6 has an opening or openings made thereto. The second baffle 6 can be arranged to move supported by, e.g., a rail connected to the first baffle 5. In detail A of FIG. 2, the nozzle 1 is shown in its normal operating position, wherein the openings of the stationary baffle 5 and the movable baffle 6 coincide so as to permit the coating spray to reach via the openings of the baffles 5, 6 the surface of the web running above the nozzle 1. Furthermore, the opening of the stationary baffle 5 delineates accurately the margin of the coating spray emitted by the spraying nozzle 1 before the spray impinges on the paper web. In detail B of FIG. 2, the nozzle 1 is shown in its washing position, wherein the movable baffle 6 is first moved by means of the actuator 4 into a position that offsets the coincidence of the openings of the stationary baffle 5 and the movable baffle 6. Herein, the washing liquid pumped through the nozzle 1 cannot reach the surface of the paper web.

In both of the above-described embodiments, it is advantageous to dispose the baffle 2, 6 so that it is in its washing position as close as possible to the tip of the nozzle 1, in front of the spray emitted by the nozzle 1, because the width of the spray pattern in this position is narrow thus allowing the baffle 2, 6 to be constructed with a small shadowing area.

The invention may also be contemplated to have embodiments and applications different from those described above. The above-described exemplifying embodiments can be modified by locating the nozzles 1 above the paper web. The embodiment shown in FIG. 2 may also be implemented without the stationary baffle 5, whereby the baffle shadowing the spray emitted by the nozzle 1 comprises only a single movable plate having an opening or openings made thereto. With a suitable actuator design of the plate motion, the spray emitted by the nozzle 1 can be arranged to pass through the openings toward the paper web. The embodiment may also be implemented so that each nozzle 1 has a separate baffle adapted to rotate in front of the spray emitted by the nozzle 1, whereby the spray of the nozzle 1 toward the paper web can be controlled on and off by varying the rotation angle of the baffle. The baffle arranged to move to in front of the nozzle 1 may also be designed to have a curved shape at the hitting point of the washing-liquid spray on the baffle, whereby the baffle will more effectively deflect the spray of the nozzle 1 away from the nozzle 1. Functions different from those described above may be found for the assembly and method according to the invention. For instance, the embodiment according to the invention is usable for cutting off the coating mix application from the nozzles 1 to the paper web during a quick shutdown of the papermaking machine operation.

Thus, while there have been shown and described and pointed out fundamental novel features of the present invention as applied to a preferred embodiment thereof, it will be understood that various omissions and substitutions and changes in the form and details of the devices illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited

What is claimed is:

1. An apparatus for preventing spray emitted by a at least one spraying nozzle arranged in a plurality of rows of spraying nozzles used for coating a paper web with coating mix from reaching a surface of the paper web, each of the nozzles being disposed a distance from the surface of the paper web to be coated, comprising:

a plurality of baffles, one of said baffles being provided for each of the nozzles, each baffle being adapted to be movable to a position in front of the spray emitted by its respective nozzle and between the respective nozzle and the paper web so as to prevent the spray from reaching the surface of the paper web.

2. The apparatus of claim 1, wherein movement of each of said baffles is individually and independently controllable.

3. The apparatus of claim 1, wherein each of said baffles is comprised of an element adapted to be rotatable to the position in front of said respective nozzle.

4. The apparatus of claim 2, wherein each of said baffles is comprised of an element adapted to be rotatable to the position in front of said respective nozzle.

5. The apparatus of claim 1, wherein each of said baffles is formed by a pair of plates having openings therethrough and being adapted to move in a superimposed manner relative to one another.

6. The apparatus of claim 1, wherein each of said baffles is formed by a single plate having openings therethrough.

7. The apparatus of claim 1, wherein each of said baffles has a curved shape.

8. The apparatus of claim 2, wherein each of said baffles has a curved shape.

9. The apparatus of claim 1, further comprising an actuator means suitable for moving each of said baffles.

10. The apparatus of claim 5, further comprising an actuator means suitable for moving each of said baffles.

11. The apparatus of claim 1, wherein the spraying nozzle is disposed above the surface of the web to be coated.

12. The apparatus of claim 1, wherein the spraying nozzle is disposed below the surface of the web to be coated.

13. The apparatus of claim 1, wherein movement of the plurality of baffles is controlled so that the baffles provided for the nozzles in a row of the plurality of rows of nozzles are movable simultaneously.

14. The apparatus of claim 2, wherein movement of the plurality of baffles is controlled so that the baffles provided for the nozzles in a row of the plurality of rows of nozzles are movable simultaneously.

* * * * *